United States Patent [19]

Baber

[11] 4,008,849

[45] Feb. 22, 1977

[54] BIDIRECTIONAL TEAR STRIP MEANS FOR CARTONS AND THE LIKE

[75] Inventor: Donald D. Baber, Boise, Idaho

[73] Assignee: Boise Cascade Corporation, Boise, Idaho

[22] Filed: May 14, 1976

[21] Appl. No.: 686,641

[52] U.S. Cl. ..... 229/51 TS; 229/51 TC

[51] Int. Cl.² ..... B65D 5/54; B65D 85/00; B65D 71/00

[58] Field of Search ..... 229/51 TS, 51 TC, 51 DB, 229/51 D; 206/498

[56] References Cited

UNITED STATES PATENTS

| | | | |
|---|---|---|---|
| 1,961,559 | 6/1934 | Herrmann | 229/51 TS |
| 2,706,076 | 4/1955 | Guyer | 229/51 TS |
| 2,967,010 | 1/1961 | Cuffey, Jr. et al. | 229/51 TS |
| 3,235,167 | 2/1966 | Svensson | 229/51 TC |
| 3,306,437 | 2/1967 | Nelson | 229/51 TS X |
| 3,326,369 | 6/1967 | Tolaas et al. | 206/498 |
| 3,372,856 | 3/1968 | Erhart et al. | 229/51 TS |
| 3,458,109 | 7/1969 | Compton et al. | 229/51 TS X |
| 3,603,501 | 9/1971 | Comfer | 229/51 TS |
| 3,712,531 | 1/1973 | McCall | 229/51 TS |

*Primary Examiner*—Davis T. Moorhead
*Attorney, Agent, or Firm*—Lawrence E. Laubscher

[57] ABSTRACT

Bidirectional tear strip means for containers are disclosed, characterized in that the tear strip means are defined by at least three parallel spaced rows of slits or cuts successive pairs of which are arranged in a herringbone pattern for defining therebetween a tear strip, the successive tear strips defined by the rows of slits being operable in opposite tear directions, respectively. Preferably the slits of each row are linear, of equal length, and are equally spaced from each other. The slits of successive rows have the same acute angle — but are of the opposite sense — relative to the longitudinal axis of the tear strip defined therebetween. Preferably the slits of one row are longitudinally offset from the slits of the next row. In the preferred embodiment, the tear strips are so defined in the container blank that upon tearing of the tear strip means of the resulting container in either of two directions, the container may be divided in half for ready access to the container contents. In alternate embodiments, the tear strip means are arranged to provide access or dispensing openings in the containers.

18 Claims, 11 Drawing Figures

Fig. 9
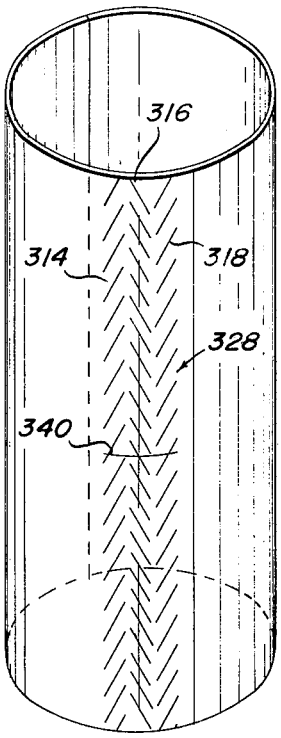
Fig. 10
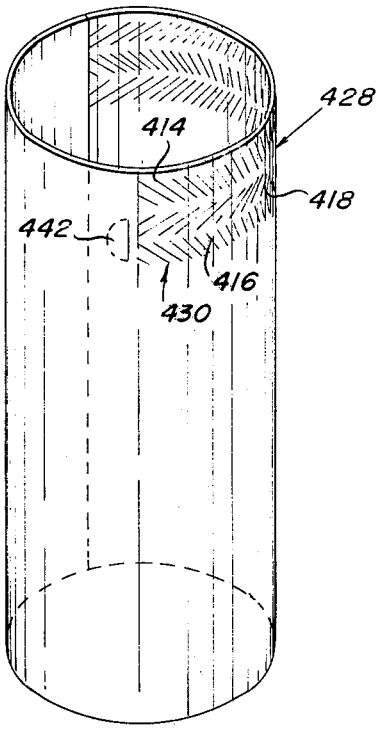
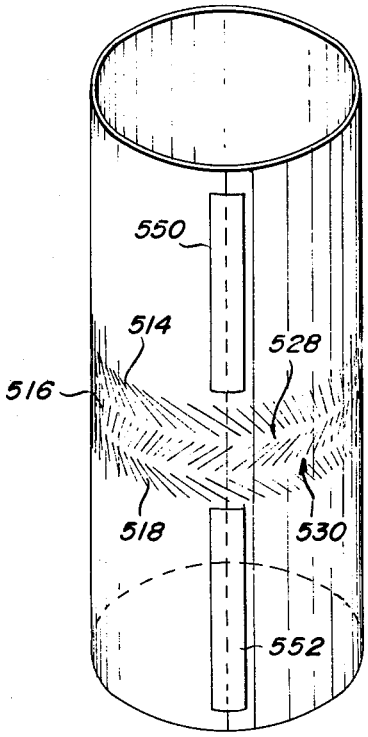
Fig. 11

BIDIRECTIONAL TEAR STRIP MEANS FOR CARTONS AND THE LIKE

BRIEF DESCRIPTION OF THE PRIOR ART

The use of tear strip means for opening cartons, envelopes and the like is well known in the patented prior art, as evidenced, for example, by the patents to Guyer, U.S. Pat. No. 2,706,076; Svensson, U.S. Pat. No. 3,235,167; and Tolaas et al, U.S. Pat. No. 3,326,369; among others.

While the prior container tear strip means normally operate quite satisfactorily, they do possess the inherent drawback that tearing of the tear strip means may be accomplished in only one tearing direction to obtain access to the interior of the container.

SUMMARY OF THE INVENTION

The present invention was developed to provide an improved container construction including at least one pair of contiguous tear strips having opposite directions of tear so that the container may be opened by tearing the bidirectional tear strip means in either a right-handed direction, a left-handed direction, or a combination of the two.

The primary object of the present invention is to provide a container blank containing a plurality of slits arranged in three adjacent parallel spaced rows, the slits of successive rows having a herringbone pattern so that the pair of contiguous tear strips defined by the rows of slits are operable in opposite directions of tear, respectively. More particularly, the slits of each row are parallel and arranged at an acute angle relative to the longitudinal axis of the associated tear strip, the slits of the rows of one tear strip diverging in one direction relative to the longitudinal axis of said one tear strip and the slits of the rows of the other tear strip diverging in the opposite direction relative to the longitudinal axis of the other tear strip, thereby defining the opposite directions of tear. Normally, the tearing operation of a tear strip is initiated at one end of the tear strip at one edge of the blank. In the alternative, intermediate tear starting means may be provided for initiating tearing of the tear strip at a location spaced from the edge of the blank.

According to a more specific object of the invention, the tear strip means are so arranged on the blank that when the blank is folded to define a container, the tear strip means extend around the periphery of the container to define means for severing the container in half thereby to afford easy access to the container contents.

In accordance with a further object of the invention, the blank is formed of corrugated board, the longitudinal axes of said tear strips extending either parallel with or normal to the corrugations of said board, respectively.

BRIEF DESCRIPTION OF THE FIGURES

Other objects and advantages of the invention will become apparent from a study of the following specification when viewed in the light of the accompanying drawings, in which.

DETAILED DESCRIPTION

Figure 1:
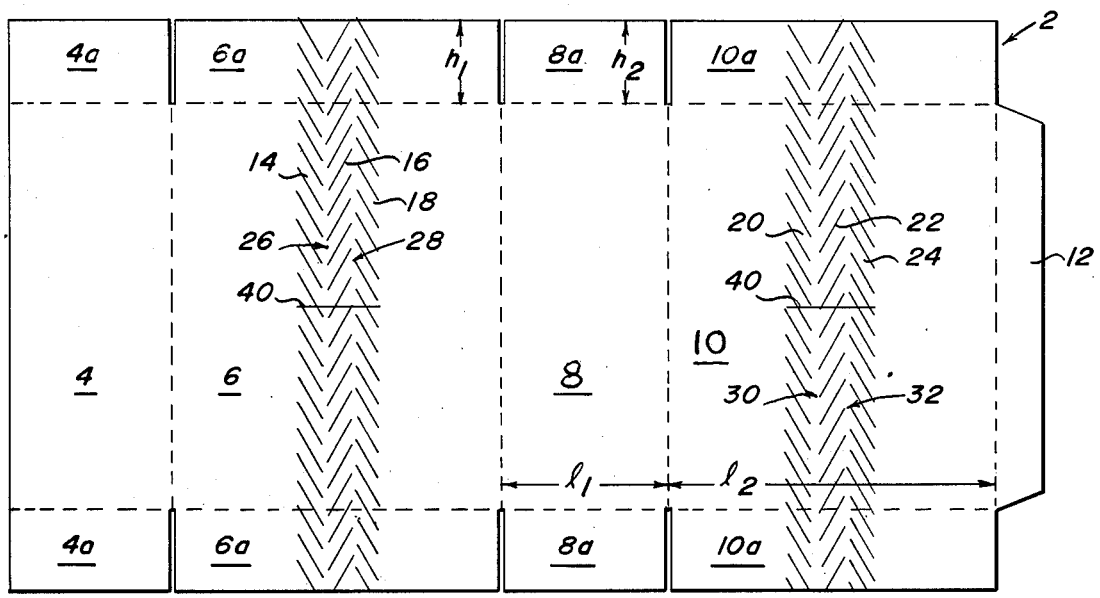
FIG. 1 is a plan view of the container blank of the preferred embodiment of the invention.

Referring first more particularly to FIG. 1, the container blank 2 of the present invention is formed of corrugated board and includes successive foldably connected side 4, bottom 6, side 8, and top 10 wall portions, respectively. At the end edges of these wall portions are foldably connected side wall flaps 4*a*, bottom wall flaps 6*a*, side wall flaps 8*a* and top wall flaps 10*a*, respectively. A top wall locking flap 12 is foldably connected with the free side edge of the top wall 10. The height $h_1$ of each of the top and bottom wall flaps 6*a* and 8*a* is equal to one-half of the length $l_1$ of the side walls, and the length $l_2$ of the top and bottom walls is greater than twice the height $h_2$ of the side wall flaps. In accordance with the present invention, the container blank 2 contains a plurality of slits arranged in two sets of three parallel spaced rows 14, 16, 18 and 20, 22, 24, thereby defining two pairs of tear strips 26, 28 and 30, 32. The sets of rows of slits extend transversely of the blank between the free edges of opposed bottom and top wall flaps, respectively, as will be described in greater detail below.

Figure 2:
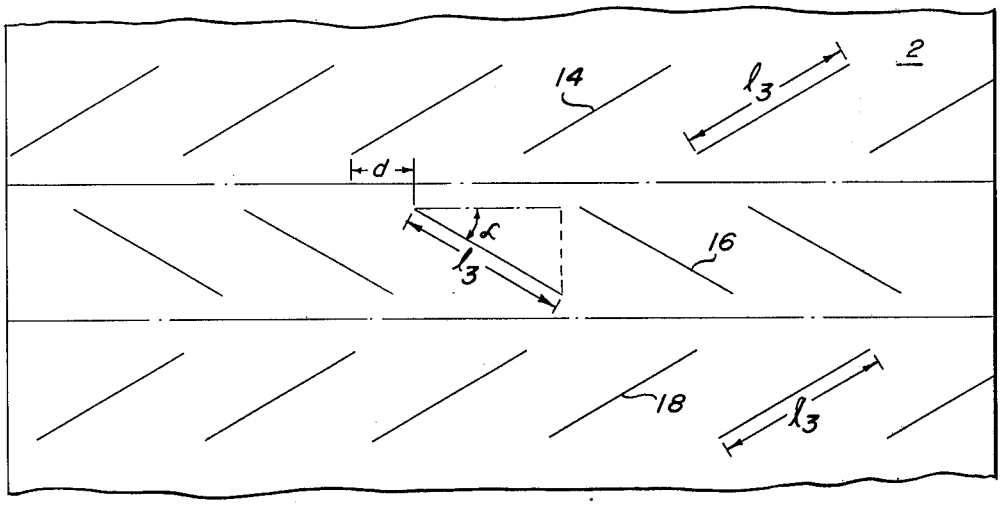
FIG. 2 is a detailed plan view of the herringbone arrangement of the slits in three adjacent parallel spaced rows, thereby defining a pair of tear strips operable in opposite tearing directions, respectively.

As shown in FIG. 2, each two successive rows of slits define a herringbone pattern, so that the contiguous tear strips defined therebetween are operable in opposite tearing directions, respectively. The blank may be so formed from the corrugated board stock that the corrugations of the board extend either parallel with or normal to the tear strip, respectively. The slits of the rows of each tear strip diverge at the same acute angle ($\alpha$) relative to the longitudinal axis of the tear strip. The slits of each row are parallel and of the same length $l_3$, and the slits of the rows on opposite sides of the longitudinal axis of each tear strip are offset longitudinally from each other by a distance $d$ equal to one-half the product of the length of the slit $l_3$ and the cosine of the acute angle ($\alpha$).

In the preferred embodiment of FIG. 1, the pairs of tear strips 26, 28 and 30, 32 are centrally arranged between and are parallel with the side edges of the bottom and top walls and the flaps connected thereto. The tear strips extend continuously between the free edges of the pairs of bottom wall and top wall flaps, respectively.

Figure 7:
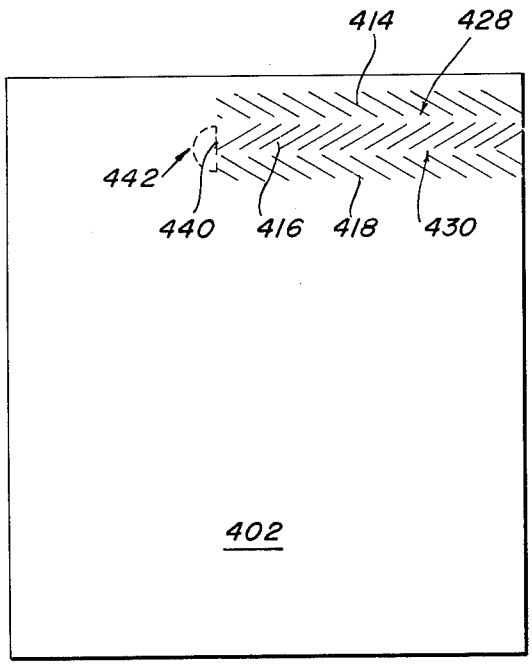

If desired, the three adjacent spaced parallel rows of slits may be provided with tear starting means intermediate the ends of associated tear strips. More particularly, the tear starting means may be in the form of a single slit 40 arranged normal to the longitudinal axes of the tear strips. If desired, means such as a semi-circular arrangement of perforations (as shown in FIG. 7), or other suitable "punch-out" means, may be provided to assist in initiating the tearing of the tear strips.

Figure 3:
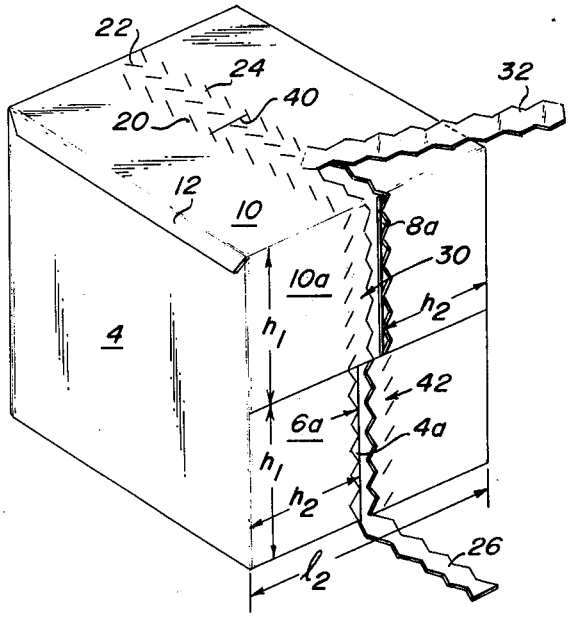
FIG. 3 is a perspective view of the container formed from the blank of FIG. 1 having a pair of partially oppositely torn tear strips.
Figure 4:
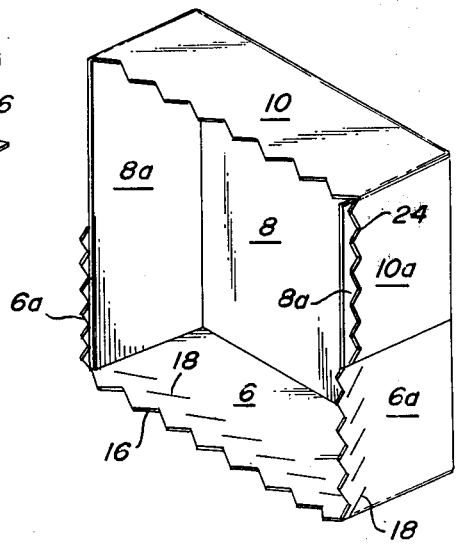
FIG. 4 is a perspective view of one-half of the severed container of FIG. 3.

The blank of FIG. 1 may be formed into the carton of FIG. 3 by first folding the side walls 4 and 8 upwardly to vertical positions relative to the bottom wall 6, whereupon the top wall 10 is folded downwardly to a horizontal position above and spaced from the bottom wall 6. The top wall locking flap 12 is then folded downwardly to a vertical position in contiguous engagement with the adjacent outer surface of the side wall 4 and is fastened thereto by suitable fastening means (such as tape, adhesive, staples, or the like). The side wall flaps 4*a* and 8*a* are then folded inwardly toward vertical positions normal to their respective side walls, and the top and bottom wall flaps 6*a* and 10*a* are subsequently folded inwardly toward vertical positions normal to their respective top and bottom walls and in contiguous engagement with the outer surfaces of the side wall flaps. The top and bottom wall flaps are secured to the outer surfaces of the side wall flaps, preferably by layers of adhesive co-extensive with the outer surfaces of the side wall flaps. Owing to the dimensions of the top, bottom and side wall flaps, a gap 42 (FIG. 3) is defined between the adjacent edges of the folded side wall flaps, said gap being arranged beneath the centrally arranged tear strip portions of the folded top and bottom wall flaps to provide an open area beneath the tear strip means. Owing to the fact that the entire outer surfaces of the side wall flaps are adhesively bonded (by conventional adhesive means) to the inner surfaces of the top and bottom wall flaps, the resulting carton is greatly strengthened at its corner and end portions.

Operation

Referring now to FIG. 3, in order to open the assembled carton, the user inserts one finger under the edge of the tear strip 32 adjacent the butt joint between the top and bottom wall flaps 10*a* and 6*a* at one end of the carton, whereupon the tear strip 32 is torn upwardly from the top wall flap 10*a* and partially from the top wall 10, as shown, Similarly, the tear strip 26 is gripped near the butt joint between flaps 6*a* and 10*a* and is torn downwardly from the bottom wall flap 6*a*, as shown. Owing to the gap 42 between the adjacent edges of the side wall flaps 4*a* and 8*a*, and to the central arrangement of the tear strip means, the tear strip means are substantially free from bonding to the side walls 4*a* and 8*a*, thereby permitting relatively easy tearing of the tear strips from the top and bottom flaps. If the tear strips 32 and 26 were to be completely torn from the carton, the carton would be divided into two of the halves to be separated for removal of the container contents. On the other hand, if the tear strips 32 and 26 were to be continued to be torn rearwardly only to the junctions between the top and bottom walls and the flaps connected thereto, respectively, the carton halves could be hingedly opened rearwardly about the remaining untorn portions of the tear strip means.

In the event that the blank is provided with the transverse cuts 40, tearing of the tear strips may be initiated at intermediate portions of the carton spaced from the butt joints between the adjacent edges of the top and bottom wall flaps, respectively.

Figure 5:
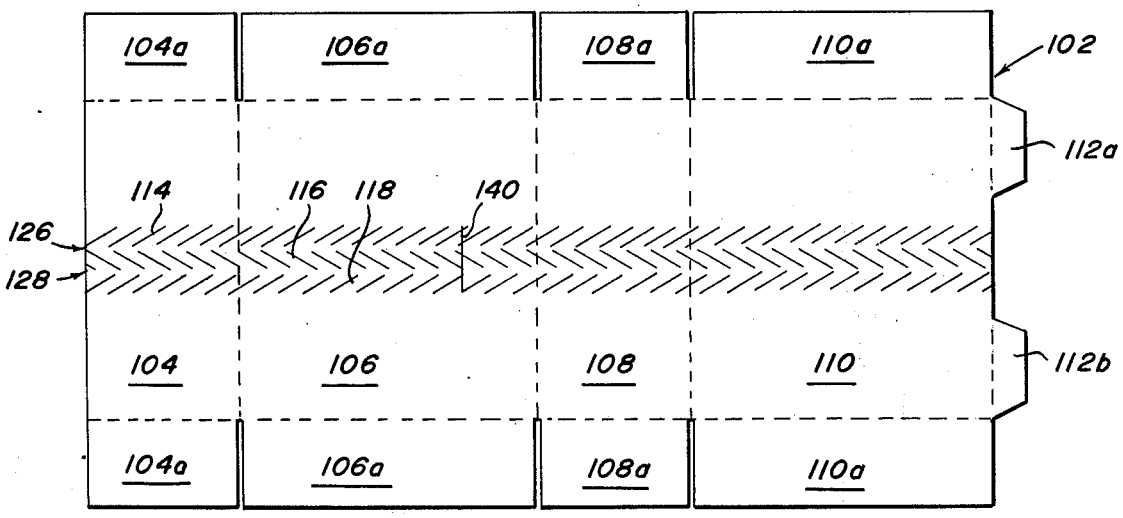
FIG. 5 is a plan view of the container blank of an alternate embodiment.

Referring now to the modification of FIG. 5, a pair of spaced locking flaps are foldably connected with the free side edge of the top wall 110. The blank 102 containing three spaced parallel rows of slits 114, 116, 118 that are arranged in a herringbone pattern to define a pair of tear strips 126, 128 that extend centrally longitudinally of the blank between the side edges thereof, said tear strips terminating between the locking flaps 112*a* and 112*b*. The blank is formed into a carton in the same manner as the carton of FIG. 3, the tear strip means being operable in either direction to divide the carton in half transversely between its ends. While normally tearing of the tear strips is initiated at their ends, in the event that transverse cuts are provided, the tear strips could be torn from a location intermediate their ends.

Figure 6:
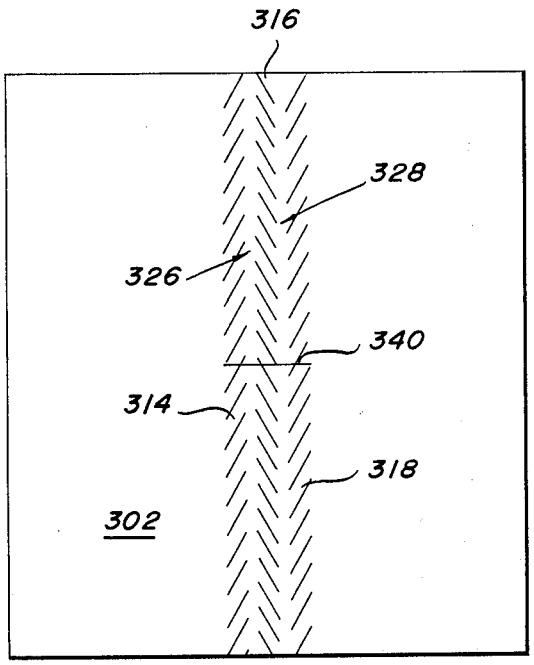
FIGS. 6–8 illustrate alternate blank embodiments of the invention suitable for forming the cylindrical containers of FIGS. 9–11 respectively.

Referring now to the embodiment of FIG. 6, the blank 302 is of rectangular configuration and contains three vertical spaced rows of slits 314, 316 and 318 arranged in a herringbone pattern to define a pair of tear strips 326 and 328 which are operable in different directions of tear, respectively. When the vertical edges of the blank are brought together and are connected (for example, by tape means, not shown) to form the blank into the cylinder illustrated in FIG. 9, the tear strips extend vertically of the cylinder, as shown. The ends of the cylinder may be closed in a conventional manner (for example, by patch top closure means, not shown). The resulting container may be opened by pulling tear strip 326 downwardly from the upper end of the container, or by pulling tear strip 328 upwardly from the lower end of the container. In the event that a transverse cut 340 is provided, tearing of the tear strips may be initiated at a point intermediate the ends of the container, the tear strip portions of tear strips 326 and 328 being torn downwardly and upwardly, respectively.

In the embodiment of FIGS. 7 and 10, the rows of cuts 414, 416, 418 extend from one edge of the blank horizontally toward an intermediate portion of the blank, thereby defining dispensing opening tear strips 428 and 430. To open the resulting cylindrical container, the tear strip 428 may be torn commencing at a position at one edge of the butt joint defined by the adjacent edges of the blank, or the tear strip 430 may be torn commencing at a starting location remote from the butt joint. To assist in the initiation of the latter tearing operation, the blank may be provided with a perforated line 442 which defines a punch out finger portion adjacent the transverse cut 440.

Figure 8:
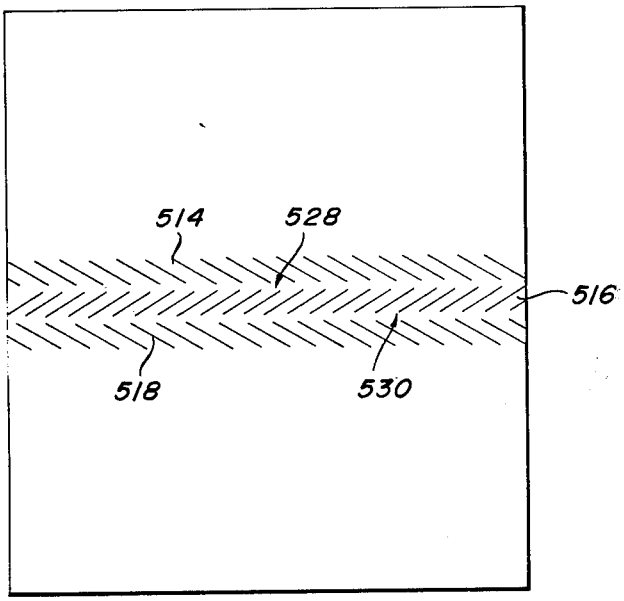

In the modification of FIGS. 8 and 11, the tear strips 528 and 530 extend continuously around the cylindrical container between the sealing tape sections 550 and 552 which connect the side edges of the blank together to form a butt joint. To open the container, tear strip 528 may be torn to the left from the butt joint, or tear strip 530 may be torn to the right from the butt joint.

Although the invention has been illustrated in connection with cartons and cylindrical containers, it will be apparent that the inventive concepts apply to tear strip means for mailing envelopes and other types of packages as well. As will be apparent to those skilled in the art, other changes and modifications may be made without deviating from the inventive concepts set forth above.

What is claimed is:

1. In a unitary blank for forming a container, the invention which comprises means defining a pair of contiguous tear strips operable in opposite tearing directions, respectively, said tear strip defining means including three generally parallel rows of slits, the slits of each row being generally parallel and arranged at an acute angle relative to the longitudinal axis of the associated tear strip, the slits of successive rows defining a herringbone pattern with the slits of the rows of one tear strip diverging in one direction relative to the longitudinal axis of said one tear strip, and the slits of the rows of the other tear strip diverging in the opposite direction relative to the longitudinal axis of the other tear strip, thereby to define said opposite tearing directions.

2. A container blank as defined in claim 1, wherein the slits of the rows of each tear strip diverge at the same acute angle ($\alpha$) relative to the longitudinal axis of the tear strip.

3. A container blank as defined in claim 2, wherein the slits of each row are equally spaced; and furhter wherein the slits of the row on one side of the longitudinal axis of each tear strip are offset longitudinally from the slits of the row on the other side of said longitudinal axis.

4. A container blank as defined in claim 3, wherein said slits have the same length, and further wherein the slits of one row are longitudinally offset from the slits of another row by a distance ($d$) equal to one-half the product of the length of the slit ($l_3$) times the cosine of acute angle ($\alpha$).

5. A container blank as defined in claim 1, wherein said three adjacent rows of slits extend continuously across said blank between opposite edges thereof.

6. A container blank as defined in claim 5, wherein said blank further contains tear-starting means positioned in spaced relation to the edges of the blank for initiating tearing of an intermediate portion of at least one of said tear strip means.

7. A container blank as defined in claim 1, wherein said three adjacent rows of slits extend from one edge of said blank and terminate at an intermediate portion of the blank.

8. A container blank as defined in claim 7, and further including tear-starting means adjacent the terminal ends of said rows of slits for initiating the tearing from the blank of that tear strip having rows of slits which diverge from said tear-starting means.

9. A container blank as defined in claim 1, wherein said blank is formed of corrugated board, and further wherein the longitudinal axes of said tear strips extend parallel with the corrugations of the board.

10. A container blank as defined in claim 1, wherein said blank is formed of corrugated board, and further wherein the longitudinal axes of said tear strips extend normal to the corrugations of said board.

11. A container blank as defined in claim 1, wherein said blank further includes a. successive rectangular side, bottom, side and top walls foldably connected by their side edges, respectively;

b. pairs of side wall flaps, bottom wall flaps and top wall flaps foldably connected with the end edges of said sides, bottom and top walls, respectively;

c. top wall locking flap means foldably connected with the free side edge of said top wall;

d. said bottom wall and said bottom wall flaps containing a first pair of said tear strips extending continuously from one free edge of one bottom wall flap to the free edge of the other bottom wall flap in parallel spaced relation relative to the side edges of said bottom wall, said top wall and said top wall flaps containing a second pair of said tear strips extending continuously from one free edge of one top wall flap to the free edge of the other top wall flap in parallel spaced relation relative to the side edges of said top wall, said first and second pairs of tear strips being equally spaced from the fold lines between said bottom and top walls and the common side wall contained therebetween, respectively;

e. said side walls being foldable upwardly to vertical positions relative to said bottom wall, said top wall being foldable to a horizontal position above and spaced from said bottom wall, and said top wall locking flap being foldable downwardly to a vertical position in contiguous engagement with the adjacent side wall, said side wall flaps being initially foldable inwardly toward positions normal to their respective side walls, said top and bottom wall flaps being subsequently foldable inwardly toward positions normal to their respective top and bottom walls and in contiguous engagement with the outer surfaces of said side wall flaps; and f. means for securing said top wall locking flap means to the adjacent side wall and for maintaining the top and bottom wall flaps in the closed position, whereby upon the tearing of two aligned tear strips having divergent slits relative to a given tear direction, access is afforded to the interior of the container.

12. A container blank as defined in claim 11, wherein said means for maintaining the top and bottom wall flaps in the closed position includes a layer of adhesive extending over substantially the entire surface of each of said side wall flaps.

13. A container blank as defined in claim 12, wherein the height ($h_1$) of each of said top and bottom wall flaps is equal to one half of the length ($l_1$) of said side walls.

14. A container blank as defined in claim 13, wherein said tear strips are centrally located between the side edges of said bottom and top walls, respectively, and further wherein the length ($l_2$) of the top and bottom walls is greater than twice the height ($h_2$) of the side wall flaps, whereby upon the closing of the side wall flaps and top and bottom wall flaps, respectively, a gap between the adjacent free edges of said side wall flaps is provided beneath said tear strips.

15. A container blank as defined in claim 1, wherein said blank further includes a. successive rectangular side, bottom, side, and top walls foldably connected by their side edges, respectively;

b. pairs of side wall flaps, bottom wall flaps, and top wall flaps foldably connected with the end edges of said side, bottom and top walls, respectively;

c. a pair of spaced top wall locking flaps foldably connected with the free side edge of said top wall;

d. said successive side, bottom, side, and top walls containing a pair of said tear strips extending continuously from the free side edge of said first side wall to the free side edge of said top wall at a position between said pair of top wall locking flaps;

e. said side walls being foldable upwardly to vertical positions relative to said bottom wall, said top wall being foldable to a horizontal position above and spaced from said bottom wall, and said pair of top wall locking flaps being foldable downwardly to a vertical position in contiguous engagement with the adjacent side wall, said side wall flaps being intially foldable inwardly toward positions normal to their respective side walls, said top and bottom wall flaps being subsequently foldable inwardly toward positions normal to their respective top and bottom walls and in contiguous engagement with the outer surface of said side wall flaps; and f. means for fastening said pair of top wall locking flaps to the adjacent side wall and for maintaining the top and bottom wall flaps in the closed position, whereby upon tearing of one of the tear strips from the container, access is afforded to the interior of the container.

16. A container blank as defined in claim 1, wherein the side edges of said blank are connected together to form a cylindrical container.

17. A container blank as defined in claim 7, wherein the side edges of the blank are connected together to form a cylindrical container.

18. A container blank as defined in claim 17, wherein said tear strip means are arranged adjacent one end of the container to afford means for defining a dispenser opening.

* * * * *